United States Patent [19]

Marton et al.

[11] Patent Number: 4,516,358

[45] Date of Patent: May 14, 1985

[54] CLUTCH ASSEMBLY FOR SANDING HEAD

[76] Inventors: Miksa Marton, 3620 Randin Blvd.; George Marton, 1835 Todd Ln., both of Windsor, Ontario, Canada

[21] Appl. No.: 576,306

[22] Filed: Feb. 2, 1984

[30] Foreign Application Priority Data

Apr. 29, 1983 [CA] Canada ..... 427102

[51] Int. Cl.[3] ..... B24B 23/02

[52] U.S. Cl. ..... 51/119; 51/170 T; 51/170 MT; 192/103 A

[58] Field of Search ..... 51/119, 120, 170 T, 51/170 MT; 192/103 A, 105 B, 105 C

[56] References Cited

U.S. PATENT DOCUMENTS 2,560,515 7/1951 Pentz ..... 192/105 B 3,275,113 9/1966 Hirano ..... 192/103 A X

*Primary Examiner*—Robert P. Olszewski

*Attorney, Agent, or Firm*—Beveridge, DeGrandi & Weilacher

[57] ABSTRACT

A clutch assembly for a sanding head is disclosed, the assembly giving a sanding head the dual functions of orbital sanding or rotary grinding. The assembly incorporates a clutch plate and actuating means between an eccentric drive head and backup pad secured thereto. The actuator moves the plate axially, depending on the rotational speed of the unit, into engagement with the drive head to effect a rotary grinding action. Release of the clutch plate therefrom due to a drop in speed converts the rotary action to one of an orbital path.

5 Claims, 3 Drawing Figures

CLUTCH ASSEMBLY FOR SANDING HEAD

FIELD OF THE INVENTION

This invention relates to sanding devices and in particular to a clutch system for a motor driven sanding device whereby the sanding device is provided with two functions, a continuous rotary action for grinding or an eccentric, orbital action for finer sanding.

BACKGROUND OF THE INVENTION

Motor driven circular sanding devices are used in two different operational functions. One is a straight rotary action where the motor drive imparts a continuous, high speed rotation to a backup pad and the sanding or grinding disc attached to it. This form of operation is used in the heavy sanding or grinding of various materials such as metal, one example being the grinding of welds and metal from automobile bodies. Another form of operation is random orbital sanding where the motor drive, through an eccentrically located spindle and drive housing, imparts an eccentric or orbital path to the backup pad and sanding disc rather than a rotary action. In orbital sanding, there is no direct connection between the center stud of the backup pad and the housing of the drive head rotated by the motor means.

In conventional practice, an operator uses one machine as a high speed grinder with a rotary action to cut through heavy paint, welds and metal and then switches to another machine of a random orbital sanding type to smooth out the deep scratch marks from the previous grinding operation. In accordance with the present invention, both forms of sanding operations are available from one machine.

Double acting sanding heads are known, one example being shown in U.S. Pat. No. 3,482,362 of Dec. 9, 1969. However, the disclosure of this patent is, like several others of the prior art, directed to a device where the sanding operation must be stopped and the machine must be mechanically manipulated to change the form of action from one sanding function to another. In the present invention the switch from one form of action to the other only requires a decrease or an increase of pressure on the sanding apparatus by the operator.

SUMMARY OF THE INVENTION

According to the present invention, a clutch assembly is provided to allow an operator to switch the function of the apparatus from random orbital sanding to rotary grinding. Utilized in this assembly is a drive head of the type shown in my Canadian Pat. No. 1078618 of June 3, 1980. This drive head incorporates a housing adapted for attachment at its top end to a pneumatic or electrically driven rotary head. The housing includes an eccentrically located spindle which is mounted in the confines of the housing by means of a plurality of bearings so that a rotary action applied to the housing is not imparted to the spindle mounted therein. Due to its eccentric location, a backup pad secured to the spindle is moved in a random orbital path through rotation of the drive head housing, the bearings between the spindle and its housing preventing a circular rotary action from being applied to the backup pad. The bottom surface of the drive head housing is planer and is preferably smooth. The drive head is of a type that can be used on any air or electric machine or on any similar type of tool.

The clutch assembly consists of two separate pieces, a circular clutch plate or disc and an actuator having weighted, peripheral segments. Both of these elements are mounted on the backup pad so they cannot rotate with respect to it. A small space is provided between the bottom surface of the drive head housing and the clutch plate so that, at low speed and under pressure from the operator, the freely mounted, eccentric spindle in the drive housing imparts a random orbital path to the backup pad and its associated sanding disc. However, when pressure is released by the operator and the motor drive is increased to a higher speed, the clutch actuator operates to move the clutch plate axially upwardly so that it engages the bottom surface of the drive housing and the random orbital path of the backup pad is immediately changed to one of a high speed rotary grinding action, the clutch actuator in effect forcing the clutch plate to an interlocking arrangement between the backup pad and the drive head housing. When the operator then applies more pressure to the tool, the speed decreases, the actuator retracts and the clutch disc pulls away from the surface contact with the drive head housing, the backup pad stops spinning and allows the drive head to run free from the backup pad so that the latter turns into a random orbital sander again, thereby removing the circle marks or grinding marks that were made when the operator was grinding.

The clutch assembly can be made out of any suitable material. It works well with an actuator formed of plastic material or the like. The clutch plate can be made of a fibre material or formed of metal and work equally as well.

The system according to the invention is most effective to use in grinding welded joints, metals of different hardnesses and the like. Adding a resilient type of material to the bottom of the backup pad renders the apparatus suitable for softer metals, finer finishes or on paint. For example, the system works well when a bodyman is removing stone chips, rust or the like from an automobile body as the operator can use the device firstly as a grinder to cut through the defects quickly and then "feather-edge" the paint in a matter of seconds by switching to the random orbital form of operation.

The reference to "high speed" operation in this disclosure will be understood by those skilled in the art to mean as high as six to twenty thousand revolutions per minute or as low as two thousand revolutions per minute depending on the diameter of the apparatus, the weight of the clutch actuator and the like.

According to a broad aspect, the present invention relates to a clutch assembly for a sanding head to provide the head with dual functions of orbital sanding and rotary grinding, the assembly comprising a drive head including an eccentrically located drive spindle mounted for rotation in and with respect to the head, the latter having a planer bottom surface. A backup pad having a centrally located stud is secured in the drive head spindle and a clutch plate and clutch actuating means are mounted concentrically on the backup pad. Guide means are provided on the backup pad together with corresponding guide grooves in the clutch plate and clutch actuating means so that the clutch plate and the actuating means move with the backup pad in a horizontal plane, the clutch plate being free to move axially on the guide means between the actuating means and the adjacent planar surface of the drive head. The actuating means includes a plurality of segments adapted to move the clutch plate axially into engagement with the drive head surface in response to high speed rotation of the drive head.

In accordance with another aspect, in a random orbital sanding device of the type including a drive head incorporating an eccentrically located spindle mounted in the head for rotation with respect thereto and a backup pad secured in the spindle, a clutch assembly is provided for mounting between the drive head and the backup pad to provide the orbital sanding device with an additional function of rotary grinding, the assembly comprising a clutch plate and clutch actuating means concentrically mounted on the backup pad, a plurality of shoulder guides spaced circumferencially on the backup pad, an aperture and guide grooves in the clutch plate and actuating means cooperating with said shoulder guides to prevent rotation of the clutch plate and actuating means relative to the backup pad; and the actuating means including a plurality of circumferencially located, weighted segments which, in response to a high rotational speed of the backup pad, move outwardly and axially upwardly to shift the clutch plate into engagement with the drive head to provide a rotary grinding action to the backup pad.

BRIEF DESCRIPTION OF THE DRAWINGS

The invention is illustrated by way of example in the accompanying drawings in which.

DESCRIPTION OF THE PREFERRED EMBODIMENT

Figure 1:
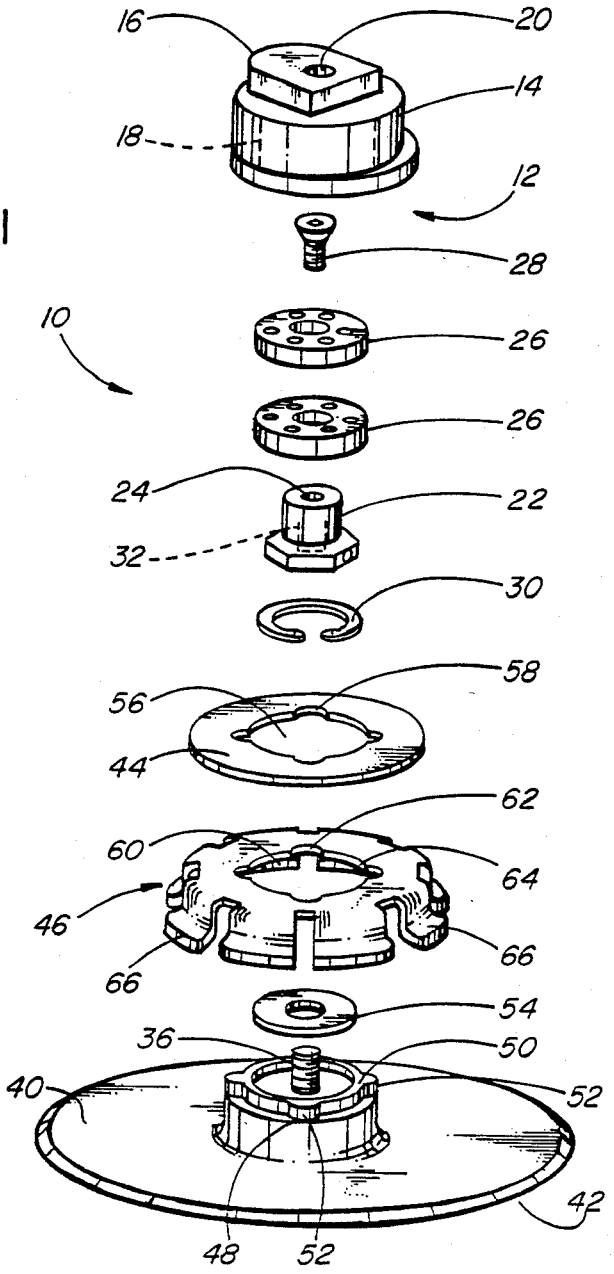
FIG. 1 is a perspective exploded view of the clutch assembly and drive head.

Referring to FIG. 1, the clutch assembly 10 includes a drive head 12 having a cylindrical housing 14 with a chuck 16 at one end thereof for connection to a pneumatic or eletric rotary drive. The housing 14 has a circular, tubular interior shown in phantom line at 18, the longitudal axis of the tubular interior 18 being offset with respect to the longitudinal axis of the chuck attachment aperture 20. A spindle 22, having a threaded bore 24 in its upper end, is mounted in the tubular interior 18 of the housing by means of a pair of ball or roller bearings 26 secured to the spindle 22 by a setscrew 28 threaded into the bore 24. The lower end of the housing 14 is provided with an angular groove, not shown, for the reception of a lockring 30 which retains the spindle 22 and bearings 28 within the confines of the housing 14.

The spindle 22 has a further bore 32 in its lower end thereof to receive the threaded stud 36 of a backup pad 40, the lower end or surface of which carries a sanding or grinding disc 42.

It will be appreciated at this point that without the inclusion of the clutch assembly about to be described, rotation of the housing 14 by a motor drive attached to the chuck 16 imparts a random orbital path to the backup pad 42 due to its connection with spindle 22 which is eccentrically located in the housing 14. As spindle 22 is mounted in the bearings 26, the backup pad 40 and its disc 42 will not rotate in a circular manner when the operator applies downward pressure on the assembly. However, there is sufficient friction between the walls of the interior of the housing 14, the bearings 26 and the spindle 22 to provide some rotation to the backup pad 42 when pressure is removed from the assembly by the operator and the housing 14 is rotated at high speed.

In order to provide a positive engagement between the housing 14 of the drive head and the backup pad 42, a clutch assembly consisting of a clutch plate 44 and clutch actuator 46 are mounted between the bottom surface of the drive head housing 14 and the backup pad 42.

The backup pad 40 is provided with a peripheral shoulder 48 and inwardly thereof a circular collar 50 of some depth, the collar having on its exterior a plurality of equally spaced guideways 52. The interior of the collar provides a pocket for the reception of an insulating washer 54, the purpose of which will be described.

The clutch plate 44 is circular and has a large central aperture 56 with a plurality of equally spaced guide grooves 58 therein, the aperture 56 sitting freely around the collar 50 on the backup pad and the guide grooves 58 having a free fit on the guideways 52 on the backup pad so the plate can move axially on the guideways 52 but cannot rotate with respect to the backup pad 42.

A similar large central aperture 60 and guide groove 62 is provided in the clutch actuator 46 so that it as well fits down onto the shoulder 48 of the backup pad around the collar 50, the guide grooves 62 engaging the guideways 52 so that the actuator as well cannot rotate with respect to the backup pad 42.

The clutch actuator 46 can be made out of any suitable material, preferably a tough, flexible plastic or a thin metal and consists of a relatively thin disc portion 64 in which the central aperture and guide grooves are provided together with a plurality of depending, heavier constructed segments 66 which are hingedly connected at their upper ends to the disc 64 so that, under centrifugal force the segment 62 will flex relative to the disc.

Figure 3:
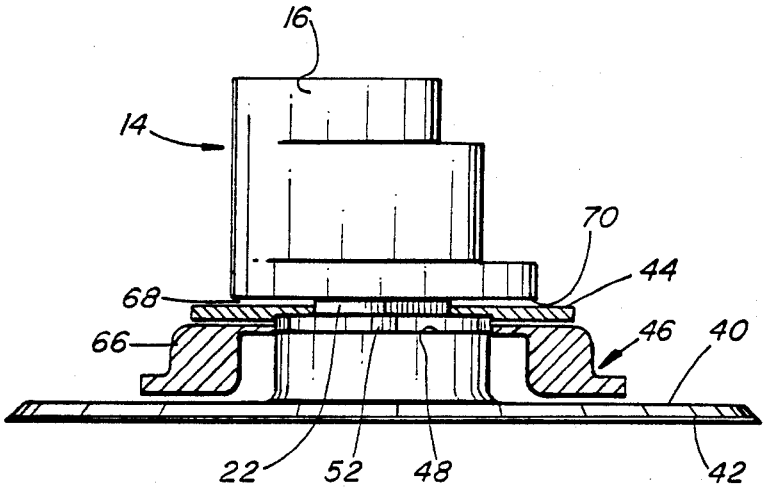
FIG. 3 is similar to FIG. 2 but showing the clutch in a disengaged position where the apparatus functions as a random orbital sander.

Turning now to FIG. 3, it will be seen that when the unit is assembled, there is a space 68 between the clutch plate 44 and the planar bottom surface 70 of the drive head housing 14. In this position, with the operator applying pressure onto the device, the housing 14 is rotated relatively slowly and there is no surface connection between the clutch plate 44 and the bottom surface 70 of the drive head 14. Due to the position of the bearings 26 between the spindle 22 and the housing 14, the backup pad 40 is operated as a random orbital sander, the orbit being dictated by the eccentric loction of the spindle 22.

Figure 2:
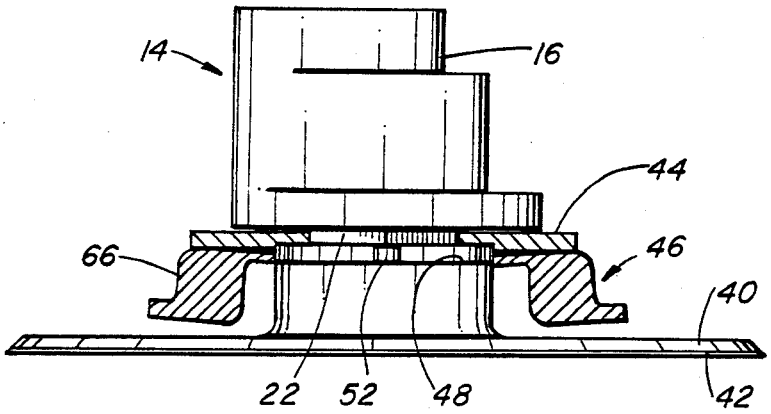
FIG. 2 is an elevation view, partly in cross-section, showing the clutch assembly in an engaged position for rotary grinding.

When pressure on the device is decreased by the operator and a high speed is applied to the rotation of the housing 14, as shown in FIG. 2, the centrifugal force applied to the clutch assembly causes the segments 66 to swing outwardly and upwardly, as shown in FIG. 2, moving the clutch plate 44 along the guideways 52 until it engages the planar lower surface of the housing 14 to provide a more positive connection between the rotating housing 14 and the backup pad 40 so that the latter takes on the high speed rotary action of the housing 14 and assumes the rotary grinding mode of operation. When the operator wants to smooth out the grinded surface, he applies pressure downwardly on the unit to lower the rotational speed so that the clutch segments 66 swing downwardly due to the decrease in centrifugal force, the clutch plate 44 disengaging from the rotating housing 14 and again converting the unit into a random orbital sander.

The insulating washer 54 separates the surface of the backup pad 42 from the head of the spindle 22 and prevents any frictionally generated heat from affecting the surface of the backup pad.

It will be appreciated that the clutch actuator 46 instead of being a single molded piece of material as shown in the drawings could be manufactured from steel with pivotal joints between the segments and the upper ring.

While the invention has been described in connection with a specific embodiment thereof and in a specific use, various modifications thereof will occur to those skilled in the art without departing from the spirit and scope of the invention as set forth in the attached claims.

The terms and expressions which have been employed in this specification are used as terms of description and not of limitation. There is no intention in the use of such terms and expressions to exclude any equivalents of the features shown and described or the portions thereof and it is recognized that various modifications are possible within the scope of the invention claimed.

We claim:

1. A clutch assembly for a sanding head to provide said head with dual functions of random orbital sanding and rotary grinding, said assembly comprising;

(a) a drive head including an eccentrically located drive spindle mounted for rotation in and with respect to said head, the latter having a planar bottom surface;

(b) a backup pad having a centrally located stud secured in said drive spindle; and (c) a clutch plate and clutch actuating means mounted concentrically on said backup pad;

(d) guide means on said backup pad, clutch plate and clutch actuating means whereby said clutch plate and actuating means rotate with said backup pad, and said clutch plate being free to move axially on said guide means between the actuating means and the adjacent planar surface of said drive head;

(e) said actuating means including a plurality of segments adapted to move said clutch plate axially into engagement with said drive head surface in response to high speed rotation of said drive head during which the segments use upwardly responsive to centrifugal force, whereby at low speeds with the clutch plate disengaged random orbital motion is obtained and at high speeds with the clutch plate engaged rotary grinding motion is obtained.

2. A clutch assembly according to claim 1 wherein said guide means comprises a concentric shoulder on said backup pad and a collar inwardly of said shoulder with a plurality of elongated guideways spaced about the exterior of said collar and located on said shoulder and guide grooves in said clutch plate and actuating means cooperating with said guideways.

3. A clutch assembly according to claim 2 wherein the guideways are high enough for the shoulder of the backup pad to support both the clutch plate and the actuating means, the guide grooves therein having a sliding fit on said guideways.

4. A clutch assembly according to claims 1, 2 or 3 wherein said clutch actuating means comprises a thin disc with said guide means therein and said plurality of segments being circumferentially attached to said disc.

5. In a random orbital sanding device of the type including a drive head incorporating an eccentrically located spindle mounted in the head for rotation with respect thereto and a backup pad secured in said spindle, a clutch assembly for mounting between said drive head and said backup pad to provide said orbital sanding device with an additional function of rotary grinding; said assembly comprising a clutch plate and clutch actuating means concentrically mounted on said backup pad, a plurality of shoulder guides spaced circumferentially on said backup pad, an aperture and guide grooves in said clutch plate and actuating means cooperating with said shoulder guides to prevent rotation of said clutch plate and actuating means relative to said backup pad; and said actuating means including a plurality of circumferentially located, weighted segments which, in response to a high rotational speed of the backup pad, move outwardly and axially upwardly to shift the clutch plate into engagement with the drive head to provide a rotary guiding action to said backup pad.

* * * * *